US006837760B2

(12) United States Patent
Mackey

(10) Patent No.: US 6,837,760 B2
(45) Date of Patent: Jan. 4, 2005

(54) METHOD FOR MODIFYING ENGINE LOADING THROUGH CHANGING OF PROPELLER BLADE SHAPE BY BENDING A PROPELLER BLADE EDGE TO MODIFY THE SECTION CAMBER AND PITCH OF THE BLADE, AND PROPELLERS MADE USING THE SAME

(76) Inventor: James Clyde Mackey, 9424 NE. Lafayette Ave., Bainbridge Island, WA (US) 98110

( * ) Notice: Subject to any disclaimer, the term of this patent is extended or adjusted under 35 U.S.C. 154(b) by 0 days.

(21) Appl. No.: 10/155,669

(22) Filed: May 24, 2002

(65) Prior Publication Data

US 2003/0220028 A1 Nov. 27, 2003

(51) Int. Cl.[7] ..... B23P 15/02

(52) U.S. Cl. ..... 440/49; 440/50; 416/223 R; 29/889.6

(58) Field of Search ..... 440/49, 50; 29/889.6; 416/223 R

(56) References Cited

U.S. PATENT DOCUMENTS 2,013,705 A * 9/1935 Warren ..... 72/31.02
3,032,092 A * 5/1962 Erlbacher ..... 72/293
3,704,500 A * 12/1972 Okamoto ..... 72/339
4,143,536 A * 3/1979 Okamoto et al. ..... 72/342.6
4,161,056 A * 7/1979 Dunham ..... 29/402.09
4,222,259 A * 9/1980 Junes ..... 72/293
5,315,856 A * 5/1994 Mackey ..... 72/389.6
5,377,521 A * 1/1995 Mackey ..... 72/374

* cited by examiner

*Primary Examiner*—Andrew Wright
(74) *Attorney, Agent, or Firm*—Dorsey & Whitney LLP

(57) ABSTRACT

The present invention is directed to a method of altering the pitch of a propeller through localized bending of its blades. To alter the propeller's pitch the camber of at least one of its blades is changed by bending a portion of a trailing edge, a leading edge, or both edges relative to a remainder of the blade. A bent portion can be located away from a tip of the blade at a distance that is less than or substantially equal to 60% of a radius of the blade, and bending preferably commences at a distance in from an edge of a blade of up to 50% of a section width of the blade. The maximum preferable change in pitch at any location on the radius due to bending is 30%.

9 Claims, 6 Drawing Sheets

METHOD FOR MODIFYING ENGINE LOADING THROUGH CHANGING OF PROPELLER BLADE SHAPE BY BENDING A PROPELLER BLADE EDGE TO MODIFY THE SECTION CAMBER AND PITCH OF THE BLADE, AND PROPELLERS MADE USING THE SAME

TECHNICAL FIELD

This invention relates generally to methods for modifying engine loading by altering propeller pitch. More specifically, the present invention relates to methods for altering propeller pitch and section camber through bending of propeller blade edges, and propellers altered by such methods.

BACKGROUND OF THE INVENTION

Many ships suffer from engine overloading caused by heavy running propellers. A ship's propeller is heavy running when its size or pitch is improperly matched with the ship's engine, causing the engine to become overloaded thereby exceeding the manufacturer's limit for maximum continuous operation. The pitch of a propeller is the distance traveled by a vessel to which a propeller is attached when the propeller completes one revolution. The higher the pitch of a propeller, the more load is placed on the engine, and the lower the rpm will be. Conversely, the lower the pitch of the propeller, the lower the load placed on the engine, and the higher the rpm will be. Although mismatch of a propeller and engine can be present when a vessel is assembled, it more commonly develops gradually as an engine weakens due to age and wear. Problems associated with heavy running propellers can be serious, including increased maintenance costs and a necessary reduction in a ship's operating speed.

Several methods exist in the prior art for correcting heavy running propellers. For example, a heavy running propeller can be replaced with a new propeller designed to properly match the available power from the engine. While being an effective solution, the costs of such an operation, both from the new propeller, and from the labor and downtime of the ship incurred during replacement efforts, can be prohibitive.

Another technique for correcting a heavy running propeller consists of re-pitching the propeller without changing the camber of its blades. As illustrated in FIG. 1, this method involves the twisting of a propeller blade 104 relative to a hub 106 to which it is attached, from an original blade position 108 to a new blade position 110. Twisting the blade in this fashion decreases the pitch of the propeller by rotating a trailing edge 112 of the propeller blade 104 through an arc 116 towards the bow of the ship, while rotating a leading edge 118 through an arc 120 in a direction away from the bow of the ship. This method is advantageous over the above mentioned propeller replacement procedure because it avoids the expense of buying a new propeller. It has several shortcomings, however, since it requires the removal of the heavy running propeller and the use of a land-based propeller workshop with equipment large and powerful enough to twist the propeller blades relative to the hub. Additionally, all the while this lengthy procedure is being conducted, the ship must remain idle.

Still another means for correcting a heavy running propeller is the reduction of a propeller's blade areas. This can be done by reducing a propeller's diameter, or by reducing the trailing edge and/or leading edge of a blade by cutting away blade material and grinding the pressure side of the blade surface to slightly reduce the propeller's pitch and camber. In cases where the degree of overload is especially pronounced, it is sometimes necessary to combine diameter reduction with trailing edge cutting in order to achieve the desired diminution in loading. FIG. 2 illustrates a blade 202 which has undergone both diameter and trailing edge reduction. In FIG. 2, an area 204 has been removed from the trailing edge 206 of blade 202. In addition, an area 208 has been removed from a tip 210 of blade 202, decreasing the radius of the blade 202 by an amount 212.

Both trailing edge reduction and diameter reduction can be performed underwater, but both are time consuming, and normally require more time to be fully completed than an average port call of a ship to load or unload cargo. Thus either the ship must extend its stay, or the work must be performed during two or more successive stops. In addition, both trailing edge reduction and diameter reduction result in a decrease in propulsive efficiency, with diameter reduction having a more pronounced effect. Decreasing the blade section by cutting away portions of the leading edge also leaves the modified blade section more prone to cavitation. Further, the cutting and grinding involved in the process produces metal particles which can pollute the water in which the procedure is conducted. Moreover, both trailing edge reduction and diameter reduction are difficult to reverse, entailing costly and time-consuming welding to reattach previously removed blade areas.

Accordingly, there is a need for a cost effective technique for correcting a heavy running propeller which can be performed without removing the propeller from the ship—or removing material from the propeller's blades—and which can be completed in the time it takes a ship to load or unload cargo during a single port call.

SUMMARY OF THE INVENTION

The present invention is directed to a method of altering a pitch of a propeller by changing the camber of at least one of its blades. The camber of the blade is changed by bending a portion of an edge of the blade relative to a remainder of the blade. The edge may be the trailing edge, the leading edge, or both the trailing and the leading edge. If the trailing edge is bent, the portion corrected preferably lies between the tip of the blade and a point on the trailing edge located away from a tip of the blade at a distance that is less than or substantially equal to 60% of a radius of the blade. If the leading edge is bent in conjunction with the trailing edge, the corrected portion on the leading edge lies between the tip of the blade and a point on the leading edge located away from a tip of the blade at a distance that is less than or substantially equal to 30% of a radius of the blade. Bending of the blade preferably commences at a distance in from an edge of a blade of up to 50% of a section width of the blade, and the maximum change in pitch at any location on the radius due to bending is 30%.

DETAILED DESCRIPTION OF THE INVENTION

The present invention is directed to a method for modifying engine loading through changing a propeller blade's shape by bending an edge of a propeller blade to modify the blade's section camber and pitch, and propellers made using the method. Many of the specific details of certain embodiments of the invention are set forth in the following description and in FIGS. 3 through 6 to provide a thorough understanding of such embodiments. One skilled in the art will understand, however, that the present invention may be practiced without several of the details described in the following description.

Figure 1:
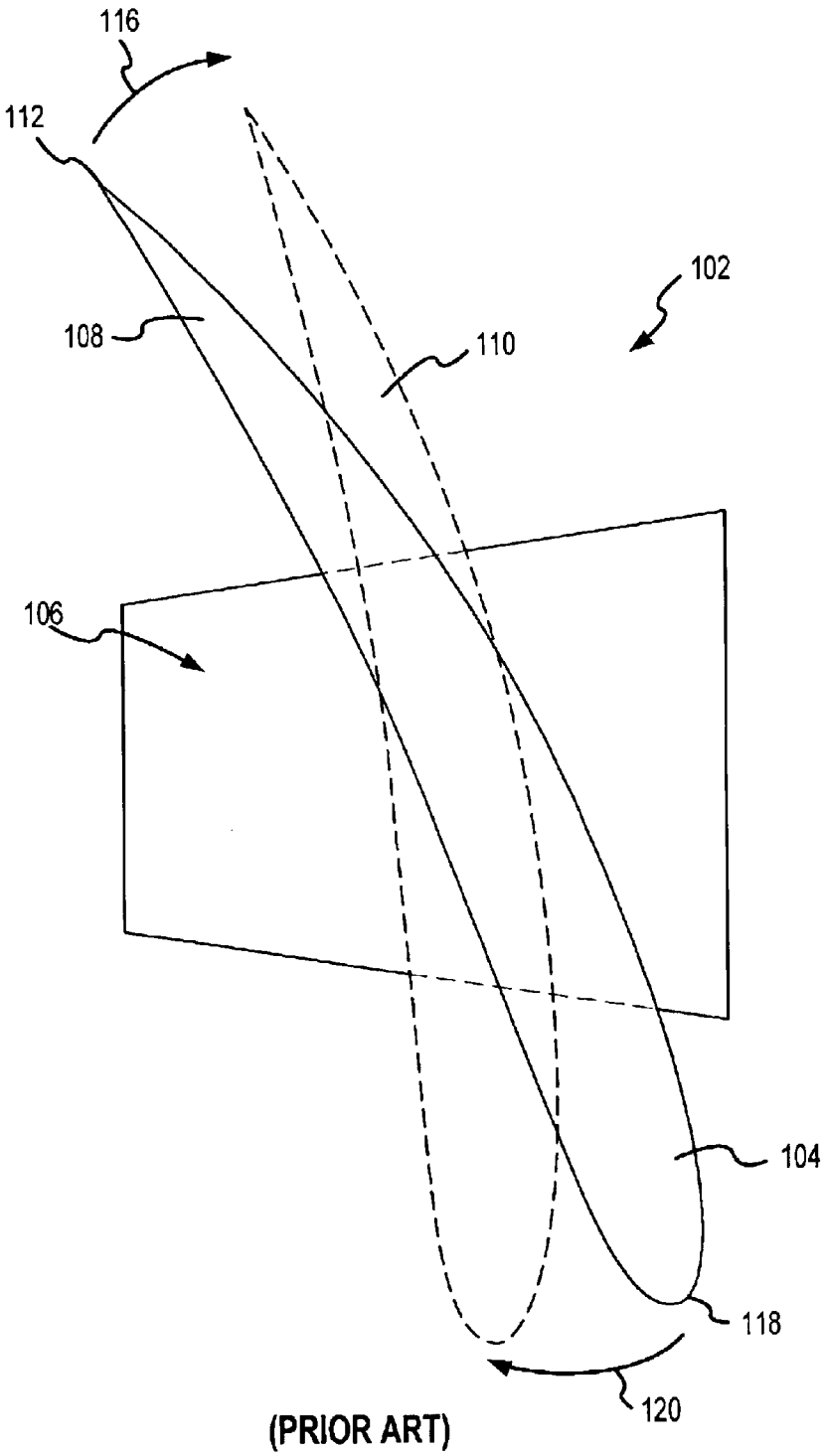
(PRIOR ART) FIG.1
FIG. 1 is an end view of a hub and propeller blade altered by a prior art technique.
Figure 2:
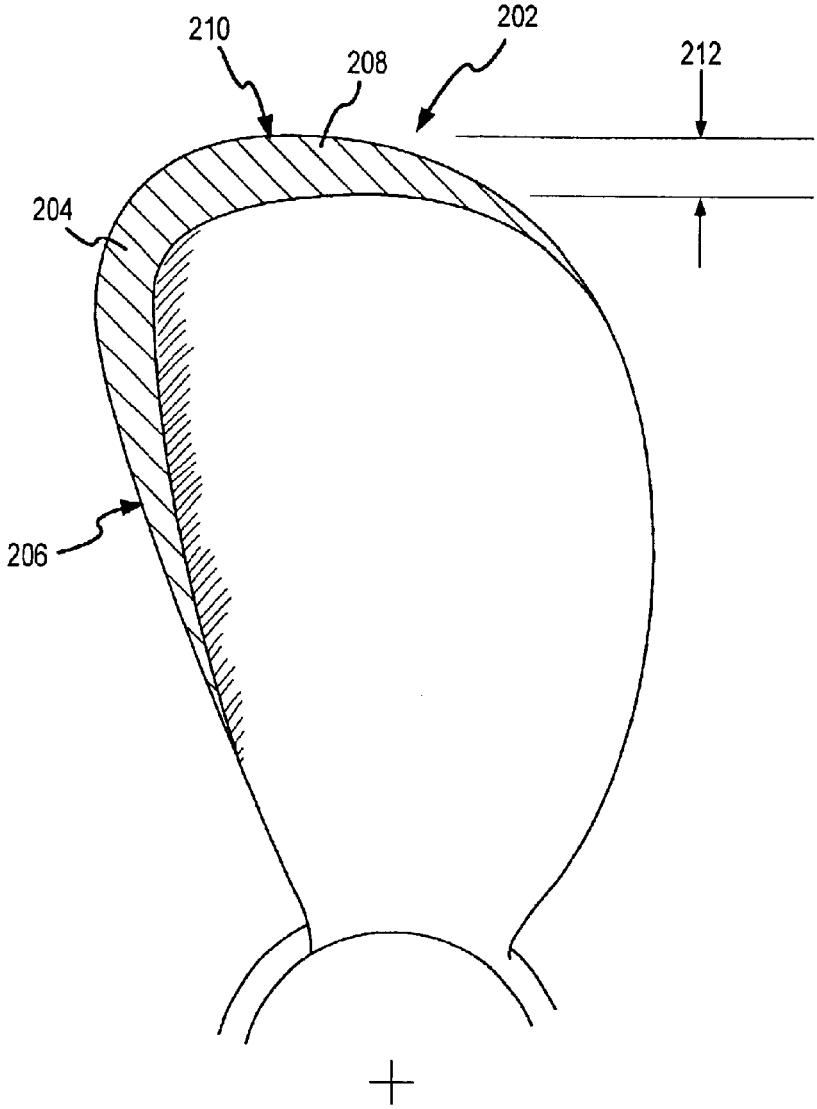
(PRIOR ART) FIG.2
FIG. 2 is an end view of a propeller blade altered by diameter reduction and trailing edge reduction according to the prior art.
Figure 3:
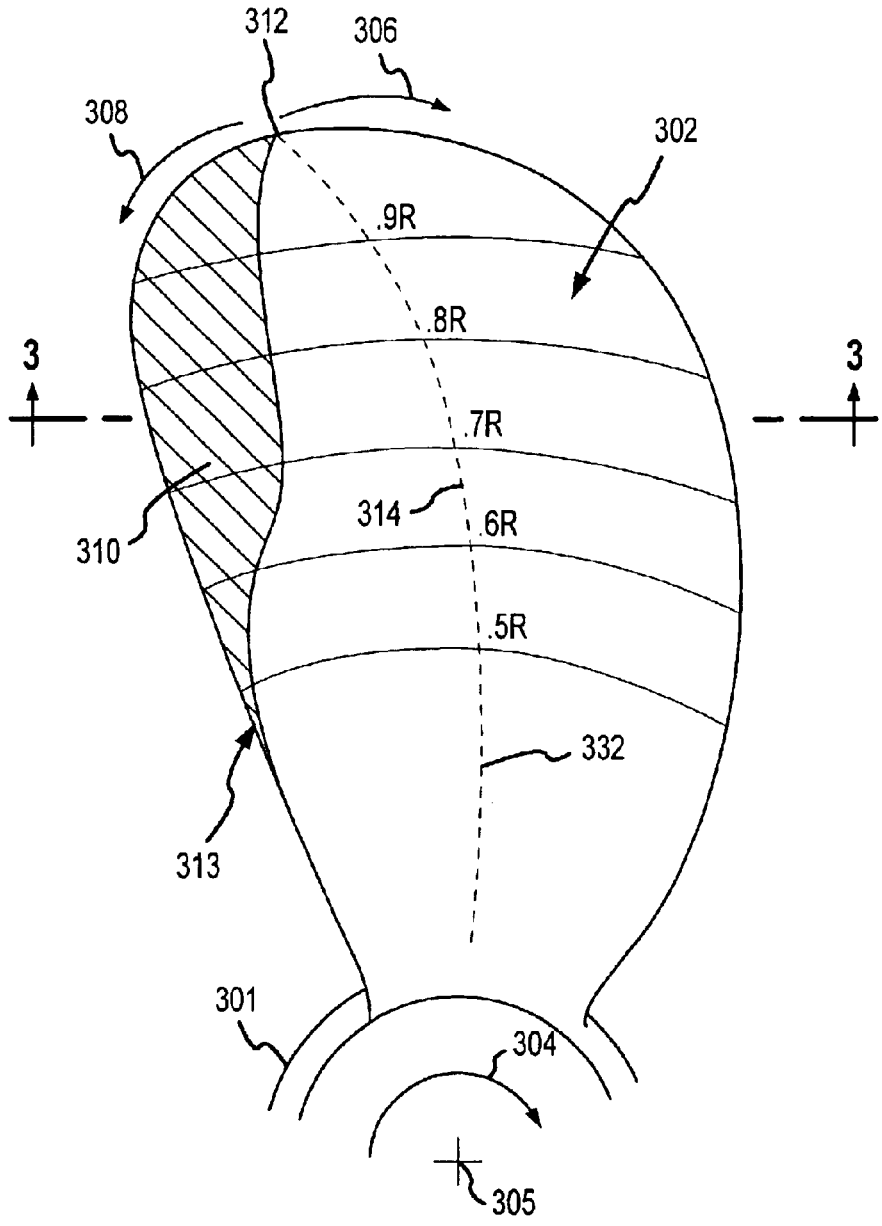
FIG. 3 is an end view of a propeller blade altered by trailing edge bending according to an embodiment of the invention.
Figure 4:
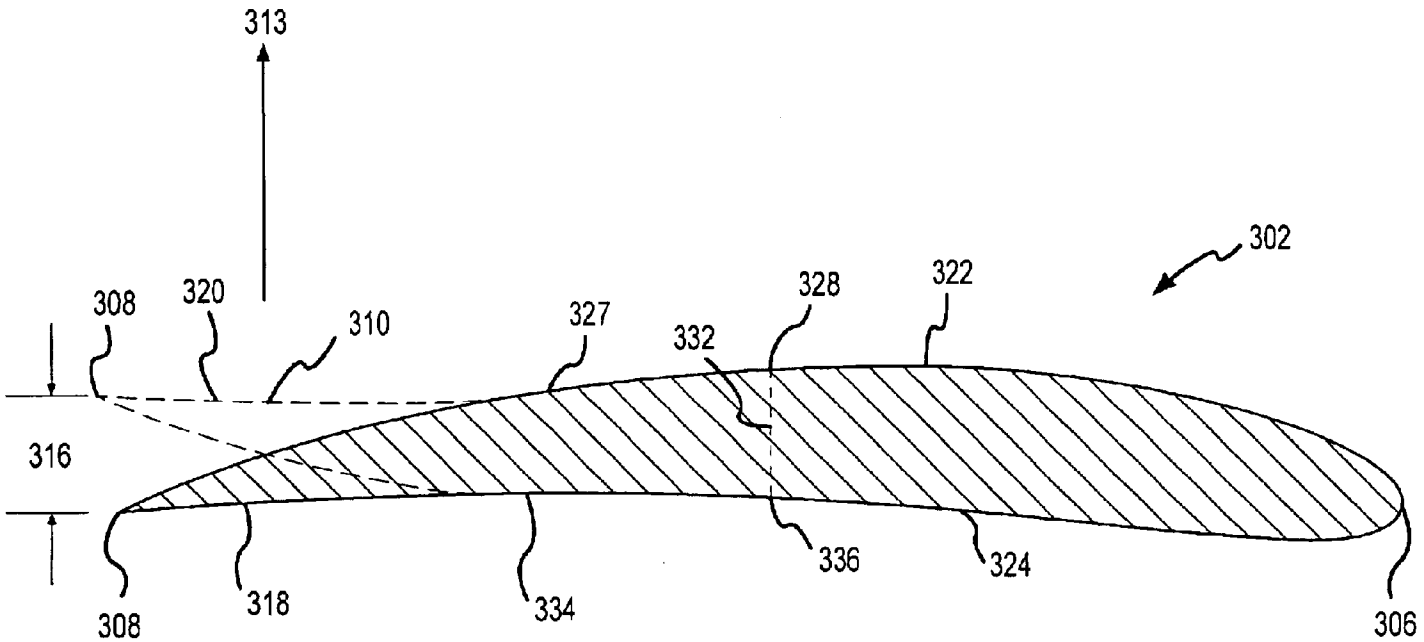
FIG. 4 is a cross-sectional view of the propeller blade shown in FIG. 3 taken along axis 3—3.

FIGS. 3 and 4 illustrate one embodiment of the invention. FIG. 3 is an end view of a propeller blade 302 attached to a hub 301. Commonly, propellers utilize two or more propeller blades, and are made from rigid materials such as steel or other metals. As the blade 302 is rotated in a direction 304 about axis 305, a leading edge 306 of the blade 302 is followed by a trailing edge 308, and the vessel to which the hub 301 is attached is moved in a forward direction. Correspondingly, if the rotation of hub 301 is reversed, the trailing edge 308 is followed by the leading edge 306 as the blade 302 rotates about the axis 305, and the vessel is moved in a rearward direction.

In the instant embodiment, a corrected portion 310 has been formed in blade 302 by bending the trailing edge 308 relative to the leading edge 306. The length of the corrected portion 310 extends from a tip 312 of blade 302 to a point 313 on the trailing edge 308 corresponding to approximately half of a radius 314 of the blade 302. The radius 314 is commonly measured from the tip 312 of blade 302 to its axis of rotation 305. It is also possible to extend the corrected portion 310 farther than shown in FIG. 3. Preferably, corrected portions extend from a blade tip to a point on the trailing edge not exceeding approximately 60% of the length of the radius away from the tip 312.

The possible widths of the corrected portion 310 are best illustrated in FIG. 4, which is a cross-sectional view of blade 302 taken along axis 3—3 of FIG. 3. As shown, the trailing edge 308 has been displaced a distance 316 in a direction 313 parallel to the direction of forward motion of a vessel to which the propeller is attached. The trailing edge 308 has been bent from its original position 318 to a new position 320, altering the contour, or camber, of a front face 322 and a rear face 324 of the blade 302. In particular, the slope of the face 322 has been altered in a region extending from the trailing edge 308 to a bend point 327 located approximately halfway between the trailing edge 308 and a centerline point 328. The centerline point 328 lies at the midpoint of the blade 302, and is the intersection point of the section centerline 332 of the blade 302 and the face 322. The centerline point 328 is also known as the point of 50% station of the face 322. In practice, the bend point 327, may be located anywhere between the trailing edge 308 and the centerline point 328. Any further than this, and the bend point 327 will encroach onto the leading edge portion of the blade section.

The exact length and width of the corrected portion 310 depend primarily on the severity of overload and the diameter of the propeller, but other factors such as the thickness and the shape of the blade 302, as well as the metallurgical properties of the propeller (such as material, casting quality, prior damage and prior repairs) are also important. The length and the width of the corrected portion 310 are also constrained by the capacity of the bending tool used to bend the trailing edge 308 of the blade 302. Typically, the section thickness of a propeller blade increases the closer the blade section is to the hub. This increased section thickness, along with the decreased access afforded a bending tool near the hub, limit the degree of bending that can be achieved in this area. This limitation is often of little consequence, however, since the hydrodynamic sensitivity of a propeller is heavily weighted toward the outer ends of its blades. Thus, sufficient bending can normally be accomplished without having to position the bending tool nearer to the hub than 40% of the length of the blade's radius.

The magnitude of the distance 316 of displacement of the trailing edge 308 is also an important factor in propeller pitch alteration and it is calculated based on several factors, including the amount of overload being experienced by the engine, the size and shape of the propeller, the thickness of the propeller's blades at the edges and at the center, the metallurgical properties of the propeller (such as material, casting quality, prior damage, and prior repairs), and the capacity of bending equipment being used. In one embodiment, the degree of overload is determined by first finding a maximum shaft rpm (Srpm) that can be achieved before symptoms of overload begin to appear in the engine—the point at which maximum continuous rating values begin to be exceeded. This value is then compared with the value of the higher shaft rpm recommended by the engine manufacturer (Msrpm) using the following formula:

$$\{(Msrpm-Srpm)/Srpm\}*100\%=\text{Degree of Overload}$$

For example, if the maximum shaft rpm of an engine before overload is 100, and a manufacturer's recommended shaft rpm is 108, then the degree of overload can be calculated to be 8%. Correspondingly, an increase in rpm of 8% must be achieved to correct the engine overload. Other methods can also be used to calculate the degree of overload, including those based on parameters other than shaft rpm.

Once the degree of overload has been calculated, it can be subsequently used to choose a magnitude for the distance of displacement of the trailing edge out of a table such as given below.

TABLE A

Value Ranges for Percent Reduction of Pitch Needed at Various Points on a Blade to Effect a 8% Increase in Shaft rpm.

| Location on Radius (measured from axis of rotation) | Range of Percent Reduction of Pitch Required |
|---|---|
| 0.95R | 4–18 |
| 0.9R | 4–18 |
| 0.8R | 4–17 |
| 0.7R | 3–15 |
| 0.6R | 2–12 |
| 0.5R | 1–9 |
| 0.4R | 0–5 |

Table A provides the required percent reduction of pitch needed at various points along the radius of a blade in order to effectuate an 8% increase in shaft rpm. These values are not to be viewed in isolation, but rather the actual value for percent reduction of pitch chosen from the allowable range at each location on the radius depends on how close in to the hub bending of the propeller blade can be performed. The farther away from the hub the bending must take place, the greater the displacement must be. For example, if bending can only be accomplished from 1R to 0.7R (from the tip of the blade to a point on the blade approximately 70% of the radius' length away from the axis of rotation of the blade), then the percent reduction in pitch at the outer radii of 0.8R, 0.9R, and 0.95R would need to be chosen from the higher end of the ranges specified in Table A. If, however, bending can be accomplished closer to the hub, the resulting bent portion can extend farther down the radius of the blade, and the displacement values chosen from Table A can come from the lower end of the range given for each radius. In general, it is preferable to use the lowest percent reduction in pitch values possible, and reductions in pitch of more than 30% for an individual radius are avoided.

Figure 5:
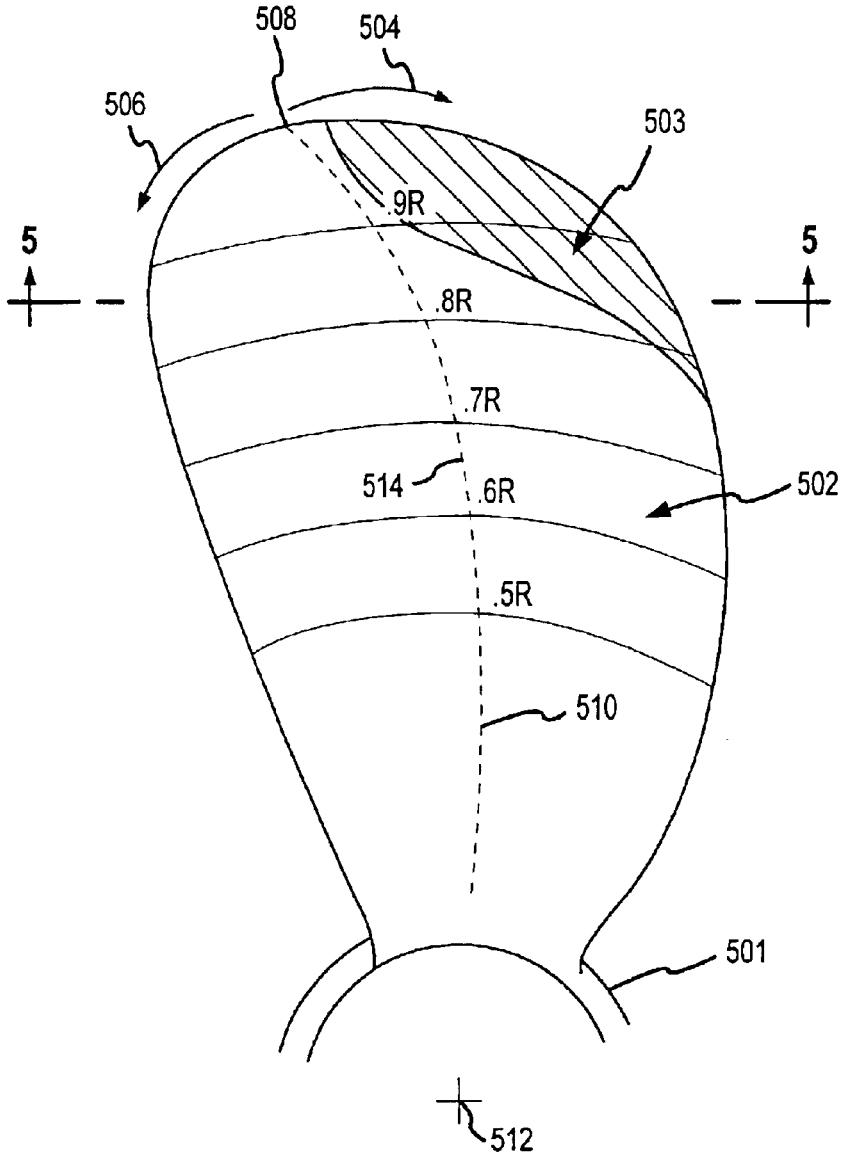
FIG. 5 is an end view of a propeller blade altered by leading edge bending according to another embodiment of the invention.

In terms of actual displacement distances, such as distance 316 in FIG. 5, values which are less than or equal to 35% of the width of the corrected portion, as measured from the edge being bent to the point of bending on the blade (this distance can be seen in FIG. 4 as the distance along face 324 from the trailing edge 308 to a point 334) are preferred. If these limits on the displacement of the edge are exceeded, a significant increase in section drag will result, reducing the propulsive efficiency of the modified propeller blade.

The displacement values given in Table A change proportionally with the change in shaft rpm being sought. For example, as shown in Table B, a 4% increase in shaft rpm will yield range values half as large as those specified for an 8% increase in Table A.

TABLE B

Value Ranges for Percent Reduction of Pitch Needed at Various Points on a Blade to Effect a 4% Increase in Shaft rpm.

| Location on Radius (measured from axis of rotation) | Range of Percent Reduction of Pitch Required |
|---|---|
| 0.95R | 2–9 |
| 0.9R | 2–9 |
| 0.8R | 2–8.5 |
| 0.7R | 1.5–7.5 |
| 0.6R | 1–6 |
| 0.5R | 0.5–4.5 |
| 0.4R | 0–2.5 |

Still referring to FIG. 4, the creation of the corrected portion 310 decreases the camber of the blade 302 by flattening out the contour of face 322 from the leading edge 306 to the trailing edge 308. As a result, the pitch of the propeller is decreased, and the load on the engine lessened, thus enabling a higher RPM to be achieved.

In the event that a ship's engine is under loaded by a propeller, the process described above can be reversed, and the trailing edge can be bent in an opposite direction to increase pitch. In such a case, the length, width and magnitude of the displacement of the bend would be calculated considering the same factors discussed above, except that in this case, the trailing edge would be bent in a direction to increase the camber of the blade and correspondingly increase the pitch of the propeller.

In addition to the employment of trailing edge bending, the pitch of a propeller can also be altered by bending the leading edge of its blades. FIG. 5 is an end view of a propeller blade 502 attached to a hub 501. A corrected portion 503 has been formed by bending a leading edge 504 relative to a trailing edge 506. As with trailing edge bending discussed above, leading edge bending can begin at a tip 508 of blade 502 and continue down the leading edge 504 in the direction of the hub 501. Preferably, the corrected portion 503 extends only up to a point approximately 60% of the length of a radius 510 away from the tip 508. Most preferably, however, the corrected portion 503 extends only up to a point approximately 30% of the length of a radius 510 away from the tip 508. The radius 510 is measured from a tip 508 of blade 502 to its axis of rotation 512. As with the discussion of trailing edge bending above, the width of the corrected portion 503 can extend from the leading edge to as far as the centerline 514 of the blade 502. Any further than this, and the corrected portion 503 will encroach onto the leading edge portion of the blade 502.

Figure 6:
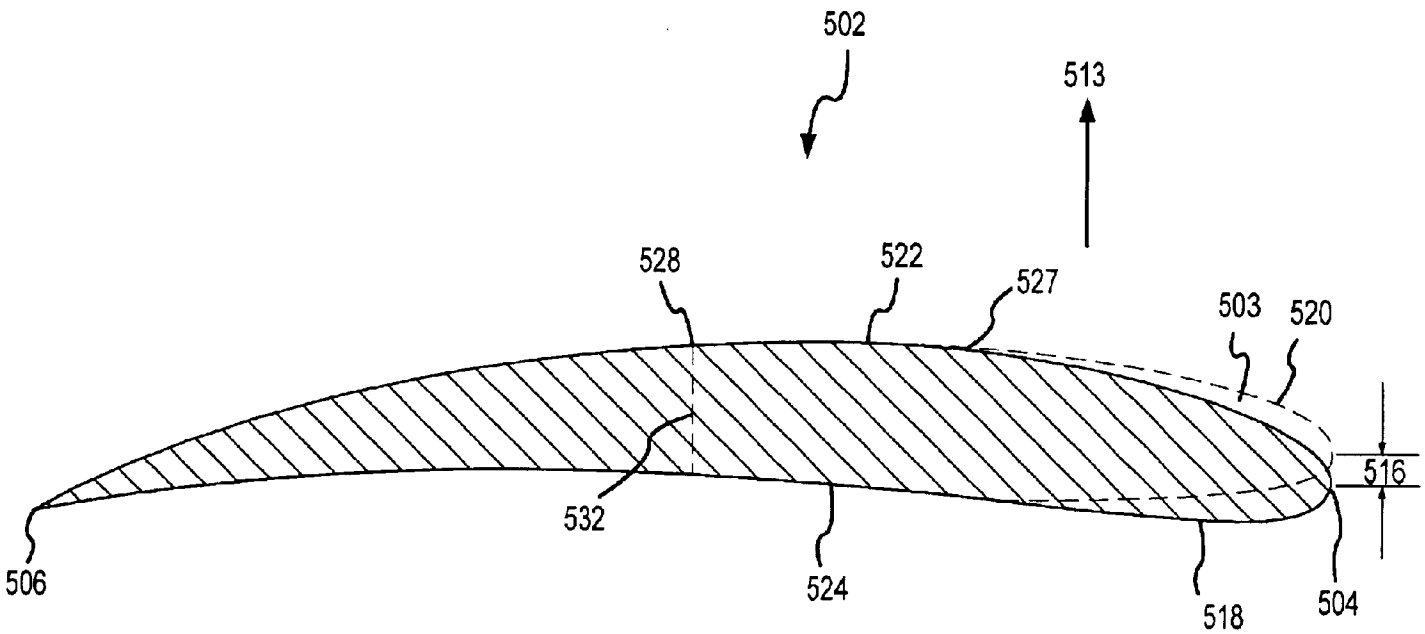
FIG. 6 is a cross-sectional view of the propeller blade shown in FIG. 5 taken along axis 5—5.

FIG. 6 is a cross-sectional view of blade 502 taken along axis 5—5 of FIG. 5 which illustrates that the leading edge 504 has been displaced a distance 516 in a direction 513 parallel to the direction of forward motion of a vessel to which the propeller is attached. The leading edge 504 has been bent from its original position 518 to a new position 520 altering the contour, or camber, of a front face 522 and a rear face 524 of the blade 502. In particular, the slope of the face 522 has been altered in the region extending from the leading edge 504 to a bend point 527 located approximately halfway between the leading edge 504 and a centerline point 528. The centerline point 528 lies at the midpoint of the blade 502, and is the intersection point of the section centerline 532 of the blade 502 and the face 522. The centerline point 528 is also known as the point of 50% station of the face 522. The bend point 527, may be located anywhere between the leading edge 504 and the centerline point 528. Any further than this, and the bend point 527 will encroach onto the trailing edge portion of the blade section.

While bending of the leading edge and the trailing edge can each be done singularly, they can also be done in combination to produce an even more pronounced change of a blade's camber and a propeller's pitch. This can often be an attractive option when the trailing edge has already been bent to a maximum displacement or when the section thickness or blade configuration restrict bending to areas located near the blade tip. When trailing edge bending and leading edge bending are done in combination, often the length of a corrected portion on the leading edge is shorter than that on the trailing edge, extending from a tip of the blade up to a distance away from the tip equal to or less than 30% of the length of the radius. Longer lengths are also possible, however. The width of the corrected portion on the leading edge can extend from the leading edge to a center point of the blade section, similar to that found with widths of leading edge sections discussed previously.

In all of the embodiments discussed above, several distinct advantages over the prior art accrue. For example, in contrast to the prior art techniques of trailing edge reduction and diameter reduction, the current invention does not involve the removal of blade material. As a result, it can be completely reversed by bending the corrected portions back into their original positions. Trailing edge reduction and diameter reduction, on the other hand, require costly and time consuming welding in order to be reversed. Similarly, since grinding and cutting away of blade material is not part of the invention, the pollution effects of such operations are avoided. Moreover, since section length of the propeller's blades is not reduced, the increased tendency toward cavitation associated with such reductions is avoided.

Additionally, since localized bending can be performed using portable bending equipment employed underwater in the time a vessel requires to load or unload cargo, the extra costs of removing the propeller from the ship and delaying the ship's return to active service are avoided. Later occurring fine tuning, if necessary, can also be carried out as expeditiously and conveniently, without disruption of the ship's normal operating schedule.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope of invention, as those skilled in the relevant art will recognize. For example, the various embodiments described above can be combined to provide further embodiments. Accordingly, the invention is not limited by the disclosure, but instead the scope of the invention is to be determined entirely by the following claims.

What is claimed is:

1. A method of producing a desired percent increase in a shaft rpm of a vessel through localized bending of a propeller blade, the blade having a radius measured from an axis of rotation to a tip of the blade, comprising:

bending a portion of a trailing edge located approximately 40–50% of the radius' length away from the axis of rotation to decrease a pitch of the blade 0–5/8% for each percent increase in shaft rpm desired;

bending a portion of a trailing edge located approximately 50–60% of the radius' length away from the axis of rotation to decrease a pitch of the blade 1/8–9/8% for each percent increase in shaft rpm desired;

bending a portion of a trailing edge located approximately 60–70% of the radius' length away from the axis of rotation to decrease a pitch of the blade 1/4–3/2% for each percent increase in shaft rpm desired;

bending a portion of a trailing edge located approximately 70–80% of the radius' length away from the axis of rotation to decrease a pitch of the blade 3/8–15/8% for each percent increase in shaft rpm desired;

bending a portion of a trailing edge located approximately 80–90% of the radius' length away from the axis of rotation to decrease a pitch of the blade 1/2–17/8% for each percent increase in shaft rpm desired; and bending a portion of a trailing edge located approximately 90–100% of the radius' length away from the axis of rotation to decrease a pitch of the blade 1/2–9/4% for each percent increase in shaft rpm desired.

2. The method of producing a desired percent increase in a shaft rpm of a vessel through localized bending of a propeller blade according to claim 1 wherein bending a portion of a trailing edge comprises changing a pitch of the blade up to 30% at any radius on the blade.

3. The method of producing a desired percent increase in a shaft rpm of a vessel through localized bending of a propeller blade according to claim 1 wherein bending a portion of a trailing edge comprises creating a bent portion by displacing the leading edge a distance measuring up to 35% of a width of the bent portion, the width being measured from the bent edge to an origin of bending on the blade.

4. The method of producing a desired percent increase in a shaft rpm of a vessel through localized bending of a propeller blade according to claim 1 wherein bending a portion of a trailing edge comprises bending the portion of the trailing edge in a direction of a bow of a vessel where the propeller is attached to the vessel.

5. The method of producing a desired percent increase in a shaft rpm of a vessel through localized bending of a propeller blade according to claim 1 wherein bending a portion of a trailing edge comprises bending the trailing edge at a distance in from the leading edge of up to 50% of a section width of the blade.

6. The method of producing a desired percent increase in a shaft rpm of a vessel through localized bending of a propeller blade according to claim 1 wherein bending a portion of a trailing edge comprises bending a portion of the trailing edge located away from a tip of the blade at a distance that is less than or substantially equal to 60% of a radius of the blade.

7. The method of producing a desired percent increase in a shaft rpm of a vessel through localized bending of a propeller blade according to claim 1, further comprising bending a portion of a leading edge of the blade relative to a remainder of the blade.

8. The method of producing a desired percent increase in a shaft rpm of a vessel through localized bending of a propeller blade according to claim 7 wherein bending a portion of a leading edge comprises bending a portion of the leading edge in a direction away from a bow of a vessel where the propeller is attached to the vessel.

9. The method of producing a desired percent increase in a shaft rpm of a vessel through localized bending of a propeller blade according to claim 1 wherein producing an 8% percent increase in shaft rpm comprises:

bending of portion of a trailing edge located approximately 40–50% of the radius' length away from the axis of rotation to decrease a pitch of the blade 0–5%;

bending of portion of a trailing edge located approximately 50–60% of the radius' length away from the axis of rotation to decrease a pitch of the blade 1–9%;

bending of portion of a trailing edge located approximately 60–70% of the radius' length away from the axis of rotation to decrease a pitch of the blade 2–12%;

bending of portion of a trailing edge located approximately 70–80% of the radius' length away from the axis of rotation to decrease a pitch of the blade 3–15%;

bending of portion of a trailing edge located approximately 80–90% of the radius' length away from the axis of rotation to decrease a pitch of the blade 4–17%; and bending of portion of a trailing edge located approximately 90–100% of the radius' length away from the axis of rotation to decrease a pitch of the blade 4–18%.

* * * * *